US005333519A

United States Patent [19]

Holliday et al.

[11] Patent Number: 5,333,519

[45] **Date of Patent: * Aug. 2, 1994**

[54] STEEL RULE DIE AND METHOD

[75] Inventors: George L. Holliday, Greensboro; Brightman K. Holliday, High Point; Herbert G. Shimer, Jr., Greensboro, all of N.C.

[73] Assignee: Ameritek, Inc., Greensboro, N.C.

[ * ] Notice: The portion of the term of this patent subsequent to May 18, 2010 has been disclaimed.

[21] Appl. No.: 60,610

[22] Filed: May 11, 1993

Related U.S. Application Data

[63] Continuation of Ser. No. 879,944, May 8, 1992, Pat. No. 5,211,084, which is a continuation of Ser. No. 201,322, May 25, 1988, Pat. No. 5,140,872, which is a continuation of Ser. No. 701,659, Feb. 15, 1985, abandoned, which is a continuation of Ser. No. 567,942, Jan. 4, 1984, abandoned, which is a continuation-in-part of Ser. No. 299,672, Sep. 8, 1981, abandoned.

[51] Int. Cl.[5] ..... B26D 7/00

[52] U.S. Cl. ..... 76/107.8; 493/73; 493/354; 219/121.67; 219/121.68; 83/16

[58] Field of Search ..... 219/121.67, 121.68, 219/121.69; 493/61, 73, 354, 372; 83/16, 171, 177; 76/107.1, 107.8

[56] References Cited

U.S. PATENT DOCUMENTS

| | | | |
|---|---|---|---|
| 2,114,948 | 4/1938 | Wehner et al. | 93/58 |
| 2,817,273 | 12/1957 | Phillips et al. | 93/58 |
| 3,036,478 | 5/1962 | Scott et al. | 76/107.8 |
| 3,052,129 | 9/1962 | Trimble | 76/107.8 |
| 3,120,601 | 2/1964 | Berlin et al. | 219/69 |
| 3,150,550 | 9/1964 | Berlin et al. | 83/13 |
| 3,152,492 | 10/1964 | Whitecotton | 76/107.8 |
| 3,166,968 | 1/1965 | Krouskop | 83/681 |
| 3,170,342 | 2/1965 | Downie | 76/107.8 |
| 3,182,530 | 5/1965 | Scott et al. | 76/107.8 |
| 3,194,090 | 7/1965 | Becker | 76/107.8 |
| 3,283,617 | 11/1966 | Kletzker | 76/107.8 |
| 3,322,004 | 5/1967 | Wolfe | 76/107.8 |
| 3,383,969 | 5/1968 | Saunders | 83/663 |
| 3,396,620 | 8/1968 | Raphael et al. | 83/686 |
| 3,645,155 | 2/1972 | Robinson | 83/663 |
| 3,749,878 | 7/1973 | Sullivan et al. | 219/121 |
| 3,786,732 | 1/1974 | Forbes, Jr. | 93/58 |
| 3,805,657 | 4/1974 | Simpson | 83/522 |
| 3,863,550 | 2/1975 | Sarka et al. | 93/58 |
| 3,929,059 | 12/1975 | Gendron | 93/58 |
| 3,937,109 | 2/1976 | Korner et al. | 76/107.8 |
| 3,941,038 | 3/1976 | Bishop | 93/58 |
| 4,052,886 | 10/1977 | Buick | 93/58 |
| 4,053,845 | 10/1977 | Gould | 330/4 |
| 4,112,827 | 9/1978 | Kang | 93/58 |
| 4,125,757 | 11/1978 | Ross | 219/121 |
| 4,201,905 | 5/1980 | Clark et al. | 212/121 |
| 4,248,117 | 2/1981 | Bugnone | 83/863 |
| 4,249,432 | 1/1981 | Graboyes | 76/107.8 |
| 4,332,999 | 6/1982 | Wittke | 219/121 |
| 4,336,439 | 6/1982 | Sasnett | 219/121 |
| 5,140,872 | 8/1992 | Holliday et al. | 76/107.8 |
| 5,211,084 | 5/1993 | Holliday et al. | 76/107.8 |

*Primary Examiner*—David Jones

[57] ABSTRACT

A steel rule die set and method for cutting and scoring sheet material in which the male cutting and scoring die has a steel rule with knife and scoring edges secured firmly in a metal face plate having retaining laser cut openings and a complementary female counter plate having a metal plate with laser cut score lines in juxtaposition to the steel rule score edges.

27 Claims, 2 Drawing Sheets

STEEL RULE DIE AND METHOD

This is a continuation of U.S. application Ser. No. 07/879,944 filed May 9, 1992, now U.S. Pat. No. 5,211,084 which was a continuation of U.S. application Ser. No. 07/201,322 filed May 25, 1988, now U.S. Pat. No. 5,140,872, which was a continuation of U.S. application Ser. No. 06/701,659 filed Feb. 15, 1984, now abandoned which in turn was a continuation of U.S. application Ser. No. 06/567,942 filed Jan. 4, 1984 now abandoned, which was a continuation-in-part of U.S. application Ser. No. 06/299,672 filed Sep. 8, 1981, now abandoned.

BACKGROUND AND OBJECTIVES OF THE INVENTION

Steel rule dies for cutting and scoring as well as embossing sheets of cardboard and flexible materials have been fabricated from wood, laminated wood, resinated and impregnated woods, and metal "furniture" in which the steel rule cutting knives and scoring rules have been fitted into slots cut into the die body of the wood or metal and held in position by various means including the introduction of plastic materials such as epoxy resins into slots or cavernous openings in the die base to anchor securely the cutting rules and scoring rules from displacement. The semi-rigid or rigid plastic materials that have been employed as well as other rule retaining means have been time consuming to fabricate and costly to build. The life of steel rule dies that have been encavitated for supporting the steel rules by introducing plastic materials to support the rules to formulate a solid base material have not been commercially successful.

The reusable counterplates for cutting and scoring boxboard or paper board to form carton blanks must be accurately constructed for reuse on hundreds of thousands or millions of impressions and cuttings necessitating precision fabrication and highly durable materials for retaining the cutting and scoring plates or rules in position in their slots within the base or supporting die member.

The female counter plate for receiving the cutting and scoring rules must be accurately fabricated to receive the cutting and scoring rules to avoid misalignment and resulting inferior cutting and scoring of the final product.

One of the primary problems with steel rule scoring dies has been the fabrication of the female counter in which the time consuming process of chemical etching has been utilized which has been extremely costly and time consuming. Computer controlled milling of the counter plate has also been costly and time consuming.

It is an objective of the present invention to provide a steel rule scoring die and counter plate in which the steel rule cutting and scoring rules may be very accurately positioned and retained in the male die, and the female counter plate may be accurately matched with the requisite shallow slots into which the scoring rules are operatively inserted to provide the requisite score lines in the work material to reduce to a minimum torn or severed slots in the workpiece.

A further objective of this invention is to provide a steel rule die set for cutting and scoring material which has a metal face plate from which steel cutting and scoring rules are imbedded and project from the metal face plate and are retained fineries by precisely cut openings for retention without extraneous plastic materials enabling the steel cutting and scoring members to cooperate with a female metal counterplate in which laser cut complementary score line openings are provided to cooperatively receive the score members of the male die with the counter plate having secured thereto a back-up plate covering the score line openings.

Yet another objective of this invention is to provide a female counterplate having a metal face with laser cut complementary score line openings that are precisely aligned with the steel rule scoring members.

SUMMARY OF THE INVENTION

The present invention overcomes the problems of the prior art by providing a steel rule die set and method for cutting and scoring sheet material having accurate means for aligning male and female embossing members attached to the male die and in which cutting rules and scoring rules are inserted in the die through slots that are formed by laser precision cutting. Although the use of laser beams has been proposed for forming the grooves in plywood as noted in U.S. Pat. No. 3,863,550, it has not been found to be acceptable in its utilization since the grooves formed are inaccurate and the steel rule is relatively loosely held within the groove necessitating suitable filler material such as an epoxy resin or other thermoplastic or thermosetting resin material that is capable of being cured into a semi-rigid structure may be utilized to support the steel rule cutting and scoring members.

The laser beam cutting of the present invention for piercing the metal face plate and counter plate of the die set is very accurately controlled with the proper axial gas flow jet at preselected pressures and pulse rates to form precision slotted openings for receiving and retaining the steel cutting and scoring members in position and to cut the scoring slots in the female counter plate eliminating the necessity for utilization of any plastic or orbelf supporting structure within the slot adjacent to the steel rule.

The slots formed in the counter plate may be accurately controlled within the precision necessary for the highest quality cutting and scoring die but at a fraction of the time and cost.

The male cutting and scoring die metal face plate is provided with a die base and backing member which may be made of Permaplex or any other skitable rigid material that will support the bases of the steel rifle cutting and scoring members.

Other objectives and many of the advantages of this invention will become more readily apparent to those skilled in the art or steel rule die sets from the following detailed description and the accompanying claims which are not intended to be limited to the specific embodiment and modifications and equivalents are contemplated.

DESCRIPTION OF PREFERRED EMBODIMENT

Figure 1:
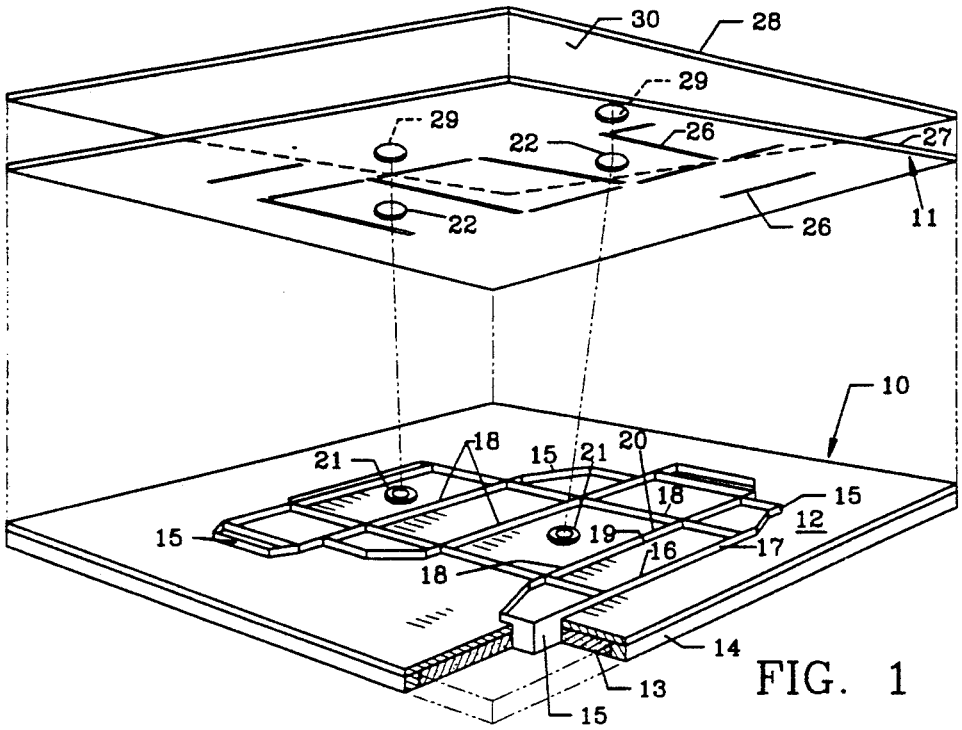
FIG. 1 is an exploded perspective view with a section removed of a steel rule die assembly embodying the invention with the components in the male die in position and the counter plate components spaced apart.

Referring to the drawing and particularly to FIG. 1, there is illustrated a steel rule die set formed of the male die 10 and the female counter plate 11 shown in vertically spaced relationship to each other. The male die has a stainless steel metal face plate 12 preferably fabricated of 410 stainless steel which is hardened sufficiently to withstand substantial wear and abrasion. The face plate has secured to its back a backing plate 13 which may be of a dense material of resinated board or Permaplex and is sufficiently dense and of high density to resist disintegration under repeated cycles pressure loadings. A metal framework 14 provides a perimeter around the male die forming a side rail and is firmly secured to the bottom of plate 12 and the edge of the backing 13. A steel cutting rule section 15 is imbedded in the backing 13 and extends or protrudes vertically above the metal face plate 12 with the top edge 16 of the steel cutting rule 15 being sharpened to provide the requisite cutting edge for the material to be cut. A relatively short segment 17 of the rule 15 extends upwardly and is exposed above the face of plate 12.

The steel scoring rule 18 is also provided with a short segment 19 that extends above the surface of plate 12 with the main portion extending downwardly through the plate 12 and into the backing 13 in a manner similar to the portion 14 of the cutting rule 15. The upper edge 20 of the scoring rule 18 has a suitable radius or curvature to form a scoring line in the sheet material to be scored to form a fold line. Die positioning and mating buttons 21 are securely mounted in the plate 12 to cooperatively receive the button locating openings 22 in the female counterplate 11.

The particular contour lines formed by the steel cutting rules 15 essentially form the perimeter of the pattern of the particular carton or box to be cut. The steel scoring rules 18 within the perimeter of the cutting rules 15 will form the scoring for the fold lines of the carton formed by the sheet material.

Figure 2:
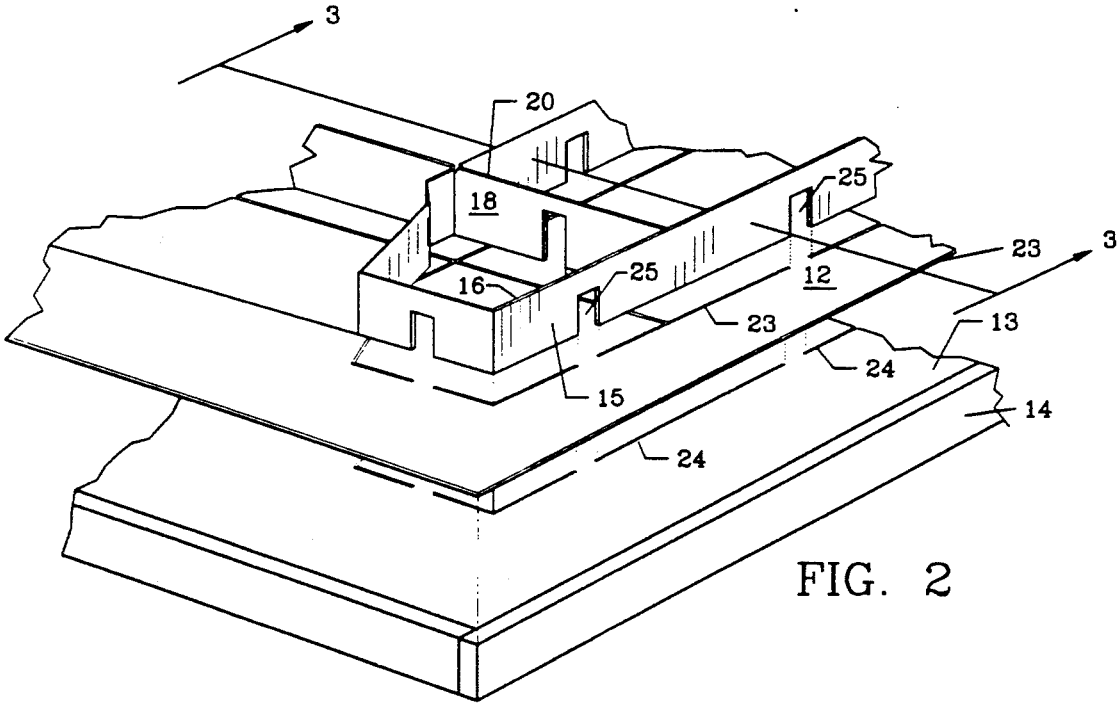
FIG. 2 is an enlarged exploded perspective view of a portion of the male die with only portions illustrated in juxtaposition before assembly.

The metal face plate 12 as shown in FIG. 2 is provided with a series of elongated rule-receiving slots which pass through the steel metal face plate 12 with only sufficient clearance to receive securely therethrough the cutting and scoring rules 15 and 18 with a minimum of clearance. Similar elongated rule-receiving slots 24 are formed in the backing member 13 for retaining the lower sections of the cutting and scoring rules 15 and 18 in a manner as shown in FIG. 1. The individual sections of the cutting and scoring rules are provided with U-shaped recesses 25 at spaced intervals for optimum rule flexibility and bending while relieving high stresses which may be present in the rules.

The back of the metal face plate 12 and the upper surface of the backing plate 13 are secured together by a suitable adhesive to prevent parting of these members.

The female counter plate 11 is also preferably constructed of 410 stainless steel which has the requisite hardness for maximum life through repeated cycles of cutting and scoring. The counter plate 11 has a series of cooperating score line slots 26 therein which will cooperate with and receive therein the upper score edge 20 of the scoring rules 18 during each cycle of the press for each carton to be cut and scored.

The female counter plate 11 has securely fastened to its reverse side a rigid backing plate 28 in which the positioning openings 29 are provided to coincide with the openings 22. The backing plate 28 is preferably fabricated of 410 stainless steel similar to the counter plate 11 and the backing plate is securely fastened by suitable adhesive to the back side 27 of counter plate 11. The smooth undersurface 30 of the backing plate will serve to cover the slotted score openings 26 in the counter plate 11 thereby serving as an anvil for the scoring rules 18 which force the sheet material into the slotted score lines 26 of the female counter plate.

Figure 3:
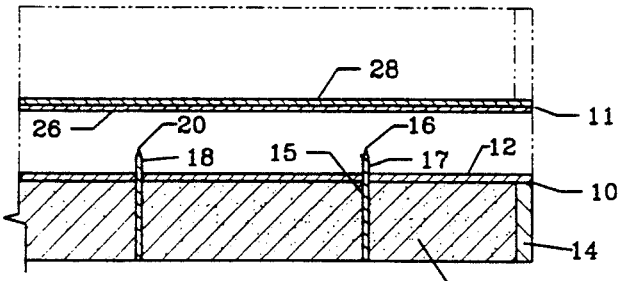
FIG. 3 is a partial transverse sectional view taken substantially along Line 3—3 of FIG. 2 with the counter plate in elevated spaced relation to the male die.

As illustrated in FIG. 3, the male die 10 is positioned beneath the counter plate 11 or the positioning may be reversed with the counter plate 11 on the face of the press with the male die above for reciprocation. The cutting rule 15 is imbedded in the backing plate 13 and the metal face plate 12 and projects upwardly a short distance above the level of the scoring rule 18 which is also firmly imbedded in the base 13 and extends through the metal face plate 12. The upper edge 20 of the scoring rule 18 is directly in line with the slot 26 in the counter plate 11 so that the sheet material inserted between the male cutting and scoring plate and the female counter plate may be cut by the steel cutting rule 15 through the cutting edge 16 when forced against the smooth surface of the counter plate while the sheet material is scored by the rounded edge 20 of the scoring rule 18 by insertion of the rounded edge 20 into the opening 26 in the counter plate.

The cutting and scoring rule-receiving elongated slots 23, 24 and 26 are precision cut by means of a laser beam under critically controlled conditions to cut specifically the stainless steel sheets. A $CO_2$ laser apparatus of the type manufactured and sold by Coherent, Inc. of Palo Alto, Calif, Model Nos. 150 and 325 have been utilized in which there is a 250–300 micro-second pulse width at a rate of 770–2000 pulses per second with a feed rate of 0.250–0.666 inches per second with an average peak power of 30–100 watts using an axial flow of let gas with oxygen at 15–65 psi pressure. A 2.5 inch focal lens is employed at 10.6 micron wave length through a 0.020 to 0.040 orifice in a brass nozzle with the focal point at the surface of the metal. The surface area being cut is maintained parallel to the cutting nozzle with 0.001 to 0.003 slots being cut in the plate ultimately to form a slot ranging from 0.010 to 0.10 inches in width The cutting of the slots 24 in the matrix packing plate or Permaplex packing does not require the aforementioned laser specifications and may be laser cut under conventional standards.

The longitudinal slots 23 and 26 require no final finishing such as grinding or milling after having been laser beam cut to the precise tolerances necessary for a tight fit with the cutting and scoring rule 15 and 18.

The laser beam cut slots 26 in the counter plate are also clear any slag or ridge eliminating the necessity for any milling or grinding.

The assembly of the cutting and scoring rules 15 and 18 may be inserted in a conventional manner after formation of the pattern. The laser beam cuts in the stainless steel sheets which average the thickness of from 0.062 to 0.125 inches.

Figure 4:
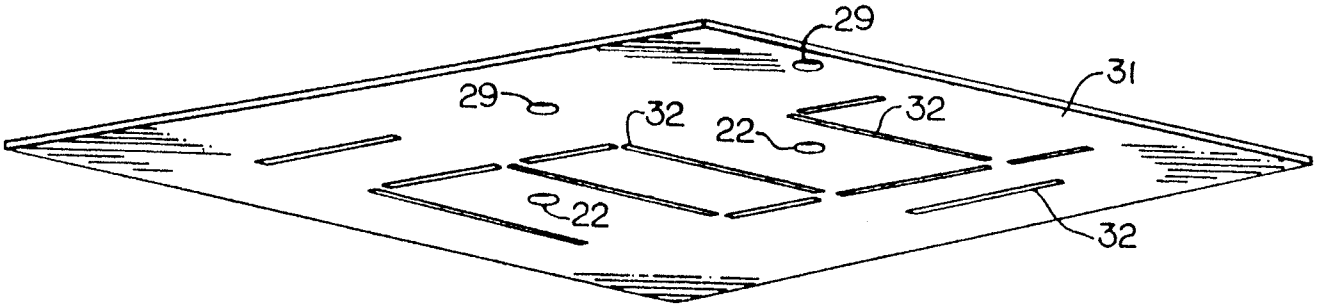
FIG. 4 is a perspective view of a modified female counter plate similar to that shown in FIG. 1.
Figure 5:
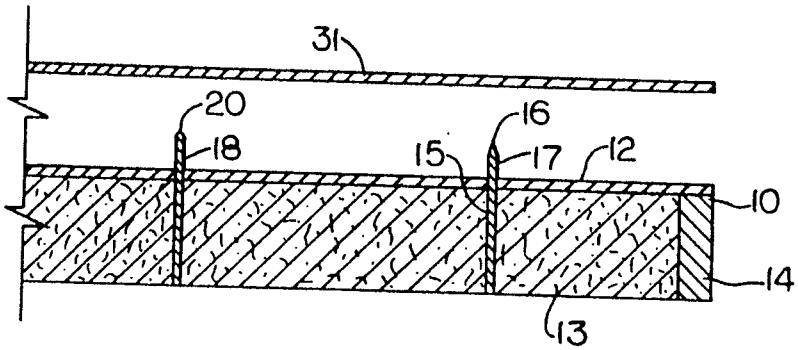
FIG. 5 is a view similar to FIG. 3 with the modified counter plate of FIG. 4.

An improved female counterplate 31, as shown in FIG. 4, may be employed which has been laser beam scribed to eliminate the necessity for a rigid backing plate 28 shown in FIGS. 1 and 3. The female 19 counterplate 30 is constructed of high carbon tool steel in which the laser scribed longitudinal slots 32 are 25 percent to 50 percent the plate thickness. In one specific example, a high carbon tool steel plate is used having a thickness of 0.062 inches and has been scribed to a depth of 0.014 inches to 0.031 inches. A Laser Coherent Model No. $325CO_2$ industrial laser has been employed in which the laser frequency is 255 pulses per second with a pulse length of one (1) millisecond at 90 to 120 watts peak average power. An axial flow jet stream of oxygen is utilized at a pressure of 15 pounds per square inch and at a 2.5 inch focal lens at 10.6 micron wave length.

We claim:

1. The method of forming a steel rule die counter plate comprising the steps of:

(a) selecting a desired width for a finished elongated, precision slot in a rigid plate;

(b) adjusting the width of a laser beam for cutting a slot in the rigid plate with a width less than the desired finished slot width;

(c) focusing the laser beam on the surface of the rigid plate;

(d) cutting the rigid plate surface in parallel and overlapping oscillations with the laser beam in increments of width during each oscillation less than the desired finished slot width; and (d) continually cutting the rigid plate with the laser beam until the desired finished slot width is achieved.

2. The method of claim 1 wherein the step of adjusting the width of the laser beam comprises the step of adjusting the width of the laser beam to cut a slot having a depth of 25 to 50 percent of the rigid plate thickness.

3. The method of claim 1 wherein the step of selecting a desired width for a finished elongated slot comprises the step of selecting a desired length and depth for the desired finished slot.

4. The method of claim 3 wherein selecting the desired depth of the desired finished slot comprises selecting a depth equal to the plate thickness.

5. The method of forming a steel rule die counter plate as claimed in claim 1 wherein the step of selecting a desired width for a finished elongated, precision slot in a rigid plate comprises selecting a desired width for a finished elongated, precision slot in a metal plate.

6. The method of forming a steel rule die counter plate as claimed in claim 5 wherein the step of selecting a desired width for a finished elongated, precision slot in a metal plate comprises the step of selecting a desired width for a finished elongated, precision slot in a steel plate.

7. The method of forming a steel rule male die comprising the steps of:

(a) selecting a desired width for a finished elongated, precision slot in a rigid plate for receiving a steel rule die cutting or scoring member;

(b) adjusting the width of a laser beam for cutting a slot in a rigid plate with a width less than the desired finished slot width;

(c) focusing the laser beam on the surface of the rigid plate;

(d) cutting the rigid plate surface in parallel and overlapping oscillations with the laser beam in increments of width during each oscillation less than the desired finished slot width; and (e) continually cutting the rigid plate with the laser beam until the desired finished slot width is achieved.

8. The method of claim 7 and including the step of inserting a steel rule cutting or scoring member into the finished elongated slot.

9. The method of claim 7 wherein the step of selecting a desired width for a finished elongated slot comprises selecting a finished slot width ranging from 0.010 to 0.10 inches in width.

10. The method of claim 7 wherein the step of adjusting the width of the laser beam comprises the step of adjusting the width of the laser beam to cut a slot width in the plate of at least 0.001 inch increments in width during each traverse.

11. The method of claim 7 wherein the step of selecting a desired width for a finished elongated slot comprises the step of selecting a desired length and depth for the desired finished slot.

12. The method of claim 11 wherein selecting the desired depth of the desired finished slot comprises selecting a depth equal to the plate thickness.

13. The method of forming a steel rule male die as claimed in claim 11 wherein the step of selecting a desired width for a finished elongated, precision slot in a rigid plate comprises the step of selecting a desired width for finished elongated, precision slot in a metal plate.

14. The method of forming a steel rule die as claimed in claim 13, wherein the step of selecting a desired width for a finished elongated, precision slot in a metal plate comprises selecting the desired width for a finished elongated, precision slot in a steel plate.

15. The method of forming a steel rule die as claimed in claim 13 wherein the step of selecting a desired width for a finished elongated, precision slot in a metal plate comprises selecting the desired width for a finished elongated, precision slot in a steel plate.

16. The method of forming a steel rule die counter plate comprising the steps of:

(a) selecting a desired width for a finished elongated, precision slot in a rigid plate;

(b) adjusting the width of a pulsating laser beam for cutting a slot in the rigid plate with a width less than the desired finished slot width;

(c) focusing the pulsating laser beam on the surface of the rigid plate with the laser nozzle parallel to the rigid plate;

(d) cutting the rigid plate surface in overlapping oscillations with the pulsating laser beam in increments of width during each oscillation less than the desired finished slot width; and (e) continually cutting the rigid plate with the pulsating laser beam with the laser nozzle maintained parallel to the rigid plate until the desired finished slot width is achieved.

17. The method of claim 16 wherein said pulsating laser beam has a peak power of 30–120 watts.

18. The method of claim 16 wherein the step of adjusting the width of the pulsating laser beam comprises the step of adjusting the width of the laser beam to cut a slot having a depth of 25 to 50 percent of the rigid plate thickness.

19. The method of forming a steel rule die counter plate as claimed in claim 16 wherein the step of selecting a desired width for a finished elongated, precision slot in a metal plate comprises the step of selecting a desired width for a finished elongated, precision slot in a steel plate.

20. The method of forming a steel rule male die comprising the steps of:

(a) selecting a desired width for a finished elongated, precision slot in a rigid plate for receiving a steel rule die cutting or scoring member;

(b) adjusting the width of a pulsating laser beam for cutting a slot in the rigid plate with a width less than the desired finished slot width;

(c) focusing the pulsating laser beam on the surface of the rigid plate with the laser nozzle parallel to the rigid plate;

(d) cutting the rigid plate surface in overlapping oscillations with the pulsating laser beam in increments of width during each oscillation less than the desired finished slot width; and (e) continually cutting the rigid plate with the pulsating laser beam with the laser nozzle maintained parallel to the rigid plate until the desired finished slot width is achieved.

21. The method of claim 20 wherein said pulsating laser beam has a peak power of 30–120 watts.

22. The method of claim 20 and including the step of inserting a steel rule cutting or scoring member into the finished elongated slot.

23. The method of claim 20 wherein the step of selecting a desired width for a finished elongated slot comprises selecting a finished slot width ranging from 0.010 to 0.10 inches in width.

24. The method of claim 20 wherein the step of adjusting the width of the laser beam comprises the step of adjusting the width of the laser beam to cut a slot width in the plate of at least 0.001 inch increments in width during each traverse.

25. The method of claim 20 wherein the step of selecting a desired width for a finished elongated slot comprises the step of selecting a desired length and depth for the desired finished slot.

26. The method of claim 25 wherein selecting the desired depth of the desired finished slot comprises selecting a depth equal to the plate thickness.

27. The method of forming a steel rule male die as claimed in claim 25 wherein the step of selecting a desired width for a finished elongated, precision slot in a rigid plate comprises the step of selecting a desired width for finished elongated, precision slot in a metal plate.

* * * * *